US007540271B2

(12) United States Patent
Stewart et al.

(10) Patent No.: US 7,540,271 B2
(45) Date of Patent: Jun. 2, 2009

(54) FUEL INJECTION LUBRICATION MECHANISM FOR CONTINUOUS SELF LUBRICATION OF A FUEL INJECTOR

(75) Inventors: Ted E. Stewart, Ponte Vedra Beach, FL (US); James Napier, Atlantic Beach, FL (US)

(73) Assignee: Advanced Global Equities and Intellectual Properties, Inc., Atlantic Beach, FL (US)

( * ) Notice: Subject to any disclaimer, the term of this patent is extended or adjusted under 35 U.S.C. 154(b) by 0 days.

(21) Appl. No.: 11/739,867

(22) Filed: Apr. 25, 2007

(65) Prior Publication Data

US 2008/0264377 A1 Oct. 30, 2008

(51) Int. Cl.
*F02M 69/04* (2006.01)

(52) U.S. Cl. ..... 123/445

(58) Field of Classification Search ..... 123/445, 123/495, 446

See application file for complete search history.

(56) References Cited

U.S. PATENT DOCUMENTS

| | | | | | |
|---|---|---|---|---|---|
| 4,393,893 | A | * | 7/1983 | Alexander | 137/246.12 |
| 4,450,854 | A | * | 5/1984 | Alexander et al. | 137/246.12 |
| 4,480,623 | A | * | 11/1984 | Thomas | 123/514 |
| 5,025,768 | A | * | 6/1991 | Eckert | 123/506 |
| 5,339,724 | A | * | 8/1994 | Rosgren et al. | 92/153 |
| 6,058,910 | A | * | 5/2000 | Simmons et al. | 123/450 |

* cited by examiner

*Primary Examiner*—Thomas N Moulis
(74) *Attorney, Agent, or Firm*—Schmid PA

(57) ABSTRACT

Disclosed is an apparatus and method for lubricating a plunger residing within a bushing of a fuel injector. The apparatus includes a fuel lubrication mechanism comprised of lubrication grooves formed within and around the outer axial surfaces of the plunger. The grooves act as fuel reservoirs for storing a small portion of fuel on the outer axial surface of the plunger. The stored or retained fuel interfaces with the walls of the bushing during injection to provide a lubricated interface between the bushing and plunger. The lubricated interface increases the service life of the fuel injector by reducing seizing, scoring and scuffing caused by excessive heat.

26 Claims, 7 Drawing Sheets

FUEL INJECTION LUBRICATION MECHANISM FOR CONTINUOUS SELF LUBRICATION OF A FUEL INJECTOR

FIELD OF THE INVENTION

The present invention generally relates to a fuel injection system and more specifically to an apparatus and method for lubricating the interface between a plunger and a bushing assembly of a fuel injector.

BACKGROUND

Fuel injectors for diesel, gasoline and most alternative fuel such as natural gas engines have various parts that often show wear and impede the performance of the injector. Such fuel injectors are usually, but not always located and seated in a tapered hole in the center of the cylinder head of each power assembly or unit. The upper internal working parts of the EMD locomotive injector are splash lubricated by oil thrown off by the working action of the rocker arm assemblies. The lower internal working parts are lubricated and cooled by the flow of fuel through the injector.

One of the lower internal working parts subject to wear is the injector plunger. The plunger is responsible for the atomization of the fuel which is accomplished by the high pressure created during the downward stroke of the plunger, which forces the fuel past a check valve and out through spray holes in the injector tip. The plunger is typically housed within the bushing, barrel, cylinder or housing of the fuel injector. The plunger is placed in motion within the fuel injector by an engine cam directly acting through a rocker arm and injector follower. Rotation of the plunger is accomplished by a rack and gear system mechanically linked to the engine governor that specifies or determines the quantity of fuel to be injected into the cylinder during each stroke.

The helix ridges defining the channel in the plunger, located near the bottom of the plunger, control the opening and closing of both fuel ports of the injector's plunger bushing. The rotation of the plunger regulates the time that both ports are closed during the downward stroke, thus controlling the quantity of fuel to be injected into the cylinder. As the plunger is rotated from the idling position to the full load position, the pumping stroke is lengthened, injection is generally started earlier, and more fuel is injected, as required for the necessary horsepower needed. The fuel spray atomization is accomplished by the creation of a significant increase in fuel pressure during the downward stroke of the plunger, which forces the fuel to lift the needle valve, thus delivering the high pressure fuel into the nozzle tip and out through the spray holes in the shape of numerous spray plumes into each cylinder's combustion chamber.

The tolerances between the plunger and bushing are required to be extremely tight to achieve the needed fuel pressure for the proper fuel atomization. Such tolerances are required to reduce the pumping losses of the plunger and bushing assembly which increases the overall injection efficiency. The interaction between the plunger and bushing of a mechanical fuel injector increases the pressure from the supplied pressure of 50-75 psi to a combustion chamber injection pressure of 10,000 to 20,000 psi. As can be expected, the required tight tolerances and friction between the plunger and bushing create extremely high temperatures.

The excessive heat generated during in-use service operation of the plunger can result in a bluish-purple discoloration found on the plunge's control surfaces. This discoloration or "bluing" is a visual indication of the presence of extremely high temperatures and is generally located on the lower half of the plunger's outer diameter surface, especially near the upper timing control helix. In many cases, the plungers may also have visible signs of seizing, scoring or scuffing which are also indications of the lack of lubrication. Such discoloration results in unacceptable "operational" heat-treating of the plunger's outer surface. Prolonged tempering of these surfaces often leads to unwanted deterioration or breakdown of the upper helix edges controlling the injection timing. If the helix edge material becomes more brittle, breaks down or erodes away, the injection timing changes from the original setting, thus resulting in a loss of fuel efficiency for that particular speed and load setting.

Thus, what is needed is a method and apparatus to aid in preventing excessive operational frictional heat and the consequential tempering between the plunger and bushing during the operation of the mechanical fuel injector. Furthermore, there is a need for a method and apparatus to prevent plunger tempering and the resultant deterioration or breakdown of the upper helix edges.

SUMMARY

The present invention includes an apparatus and method for lubricating a plunger residing within a bushing of a fuel injector. The apparatus includes a fuel lubrication mechanism comprised of lubrication grooves or pockets formed within the external control surfaces of the plunger. The grooves act as fuel reservoirs for storing a small portion of fuel on the outer axial surface of the plunger. The stored or retained fuel interfaces with the bushing walls to provide a lubricated surface. The lubricated surface increases the service life of the fuel injector by reducing seizing, scoring and scuffing caused by excessive heat.

One embodiment of the present apparatus includes a fuel injection lubrication mechanism for lubricating a fuel injector comprising a plunger having helical grooves circumscribed within and about the outer circumference of the plunger. The grooves formed within the plunger fill with fuel and provide lubrication as the plunger moves within the bushing of the fuel injector.

In greater detail, the grooves may be continuous whereby the grooves may be self filling and cleaning. The grooves may have a depth relative to the surface of the outer circumference of the plunger of up to 0.1 inches and separated by a distance of between about 0.2 to 0.3 inches. The grooves may be formed in various shapes and positions on the control surface of the plunger including the portion adjacent to the timing helix and the portion adjacent to the control helix or a combination of both portions of the plunger.

A further embodiment of the present apparatus includes a plunger for a fuel injector for lubricating a fuel injector. The plunger includes a first and a second opposed ridge formed within and encircling an axial portion of the plunger. The first ridge is commonly known as the timing helix and the second ridge is commonly known as the fuel control helix. A recessed channel encircling an axial portion of the plunger is positioned between the ridges for determining a quantity of fuel to be delivered. Adjacent to the fuel control helix is a first control surface of the plunger having a lubricating fuel reservoir formed within the first control surface. The reservoir may have a depth relative to the surface of the outer circumference of the plunger of up to about 0.1 inches.

In further detail, the lubricating fuel reservoirs may comprise between about 1 to 10 percent of a total surface area of the outer circumference of the first control surface. The lubricating fuel reservoir may further reside in the second portion of the control surface of the plunger or a combination of both the first and second control surfaces. The lubricating fuel reservoirs may be selected from the group having a configuration of a ringed groove, depression, material voids and combinations thereof.

An additional embodiment of the present apparatus includes a fuel injection mechanism for regulating the volume of fuel injected. The fuel injection mechanism includes a body wherein the body contains a rotatable plunger slidably fitted within a bushing. The mechanism further includes a first and a second port opening formed within the bushing. The plunger includes a first and a second opposed ridge and a recessed channel encircling an axial portion of the plunger formed between and the opposed ridges. The recessed channel separates the outer circumference of the plunger and defines a first and second control surface of the plunger wherein helical grooves may be formed within control surfaces.

A further embodiment includes a diesel engine. The diesel engine includes a fuel system having a plurality of cylinders and fuel injection mechanisms seated in respective cylinders. Each of the injection mechanisms includes a body, a rotatable plunger slidably fitted within a bushing, and a spray nozzle tip. The plunger includes helical grooves for lubricating the plunger within the bushing. The fuel system of the engine includes a rack and governor constructed and arranged to mechanically control the rotation of the plunger. A fuel supply line to provide fuel to the injection mechanisms is included and a fuel return line to return unused fuel to a fuel supply tank cooperating with the engine is also included.

A method of lubricating a fuel injection mechanism for regulating the volume of fuel injected is provided in a further embodiment. The method includes forming within the outer axial surface of a plunger one or more fuel reservoirs and supplying to the fuel reservoirs a quantity of fuel. The method further includes lubricating the walls of the bushing and plunger with the fuel supplied by the fuel reservoirs. The method may additionally include forming helical fuel reservoirs about the axial portion of the plunger.

DRAWINGS

Figure 6:
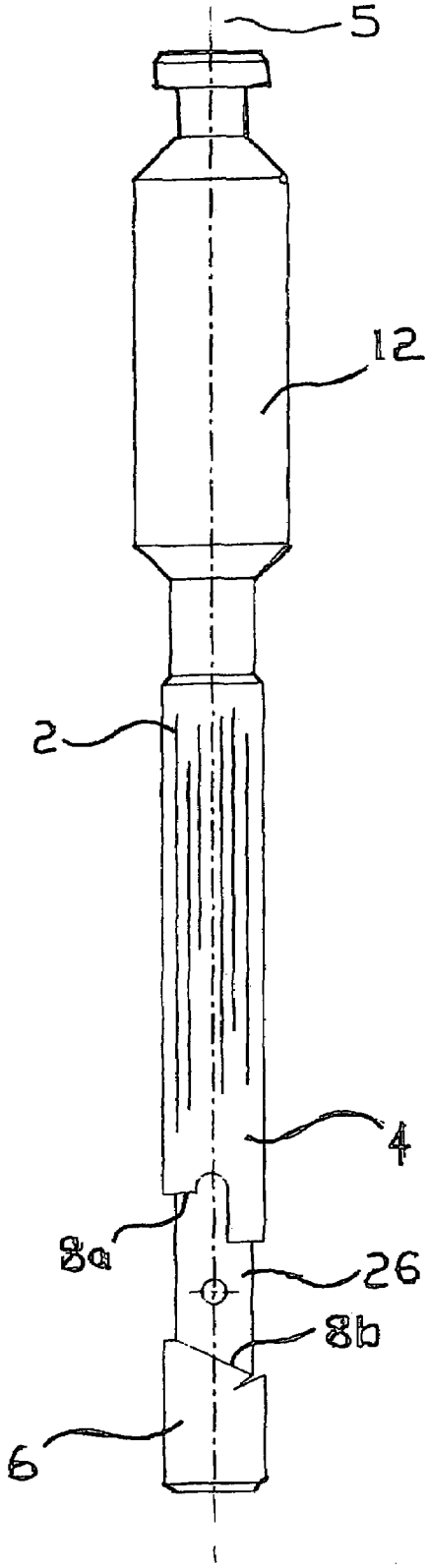
Figure 7:
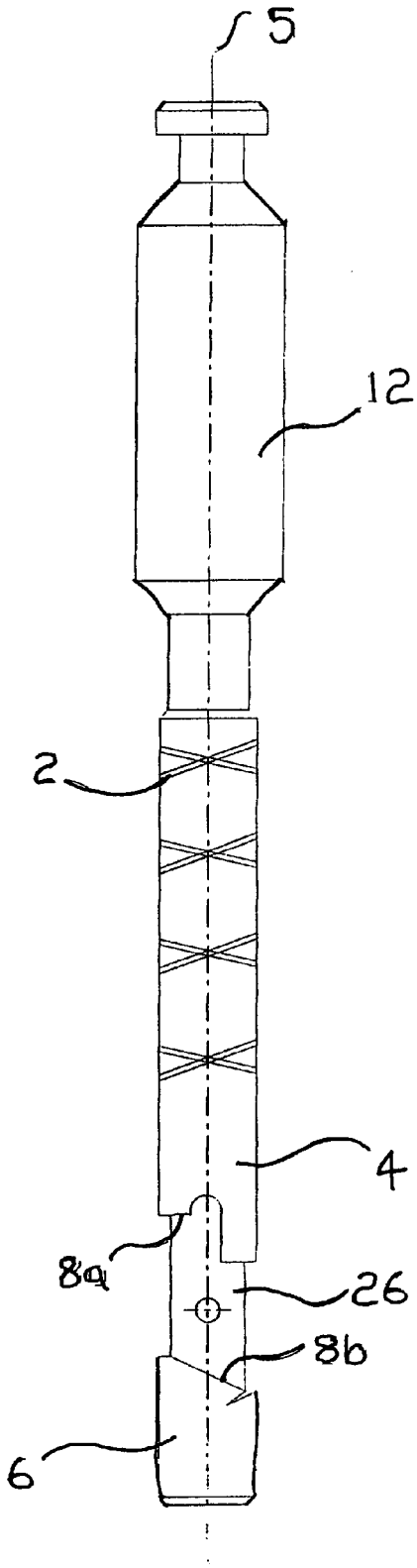

FIG. 6 illustrates the plunger having vertical grooves parallel to the longitudinal axis of the plunger and circumscribed within the outer circumference of the plunger whereby retained fuel within the grooves provides lubrication for the fuel injector; and FIG. 7 depicts the plunger having opposed helical grooves circumscribed within and about the outer circumference of the plunger wherein the opposed helical grooves intersect at an angle to form a cross-hatching pattern about the outer circumference of the plunger such that fuel is stored or retained in part within the grooves to provide lubrication for the fuel injector.

DETAILED DESCRIPTION

Disclosed is an apparatus and method for lubricating a plunger residing within a bushing of a fuel injector. The apparatus includes a fuel lubrication mechanism comprised of a plunger having lubrication grooves or pockets formed within the outer axial surface of the plunger. The grooves function as fuel retention reservoirs for storing a small portion of fuel on the outer axial surface of the plunger during the mechanical action of the plunger. The retained or stored fuel interfaces with the walls of the bushing by providing a lubricating source. The lubricating force increases the service life of the fuel injector by reducing seizing, scoring and scuffing caused by excessive heat.

Referring now in greater detail to the drawings in which like numerals indicate like parts throughout the several views, FIGS. 1-7 depict the helical grooves 2 and fuel reservoirs 24 in various embodiments of the present invention.

Figure 1:
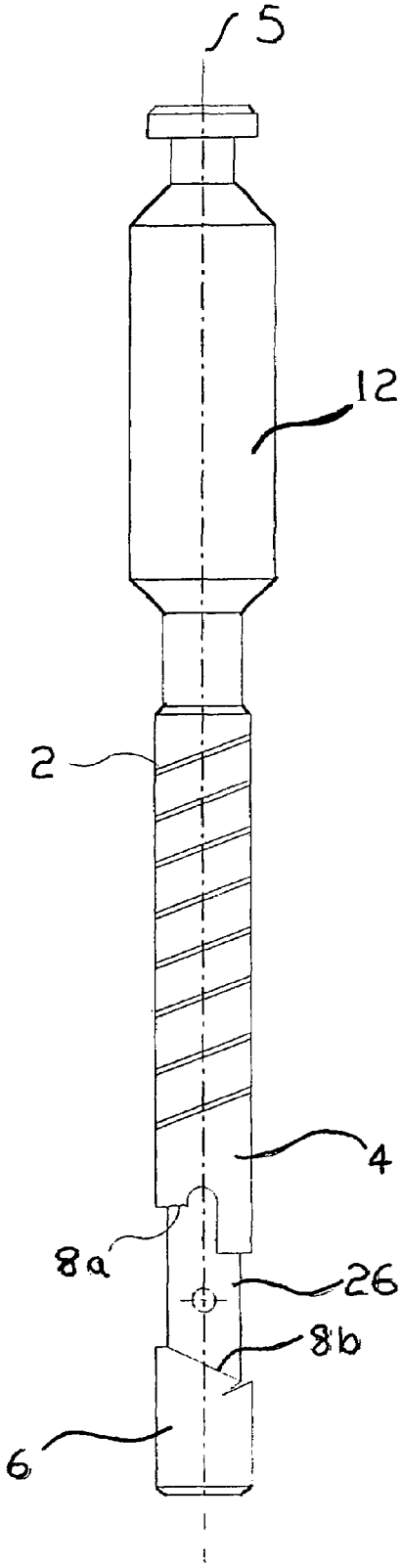
FIG. 1 illustrates the plunger including helical grooves about the outer axial surface of the plunger in a first portion of the plunger control surface adjacent to the timing helix.

FIG. 1 depicts an embodiment of the present apparatus including a fuel injection lubrication mechanism for lubricating a fuel injector comprising a plunger 12. The plunger 12 includes helical grooves 2 circumscribed within and about the outer circumference of the plunger 12. The helical grooves 2 depicted in FIG. 1 are continuous such that in the operation of the plunger 12 the grooves 2 may be self cleaning and self-filling by the flow of the fuel through the grooves 2.

The grooves 2 may have a depth relative to the surface of the outer circumference of the plunger 12 of varying degrees. For example, such a depth may be up to about 0.1 inches in one embodiment and between about 0.002 and about 0.2 inches in a further embodiment and between about 0.005 to 0.02 inches in an additional embodiment. Additionally, it is contemplated that the depth may be between 0.01 to 0.015 inches. The depth of the grooves 2 can be constant throughout the outer circumference of the plunger 12 or varied depending upon the desired degree of lubrication needed at a particular point on the plunger 12.

Further dimensions are also contemplated for the depth of the grooves 2 relative to the outer circumference of the plunger 12. For instance, the grooves 2 may be of such a depth as to capture in part a portion of fuel for lubrication while maintaining the integrity of the plunger 12. For example, if the depth of the grooves 2 were to be too great the plunger may weaken, bend and/or fracture thus causing failure of the fuel injector 32.

Additionally, the spacing of the grooves 12 may be determined by the desired degree of optimum lubrication needed for a particular application. Further, the spacing may be uniform through out the outer axial surface of the plunger 12 or varied depending upon the desired degree of lubrication needed at a particular point on the plunger 12. Typically, the closer the grooves are spaced about the outer axial surface of the plunger 12, the greater the degree of lubrication provided between the plunger and the bushings 14. For example, the grooves may be separated by a distance of between about 0.2 to 0.3 inches.

Figure 2:
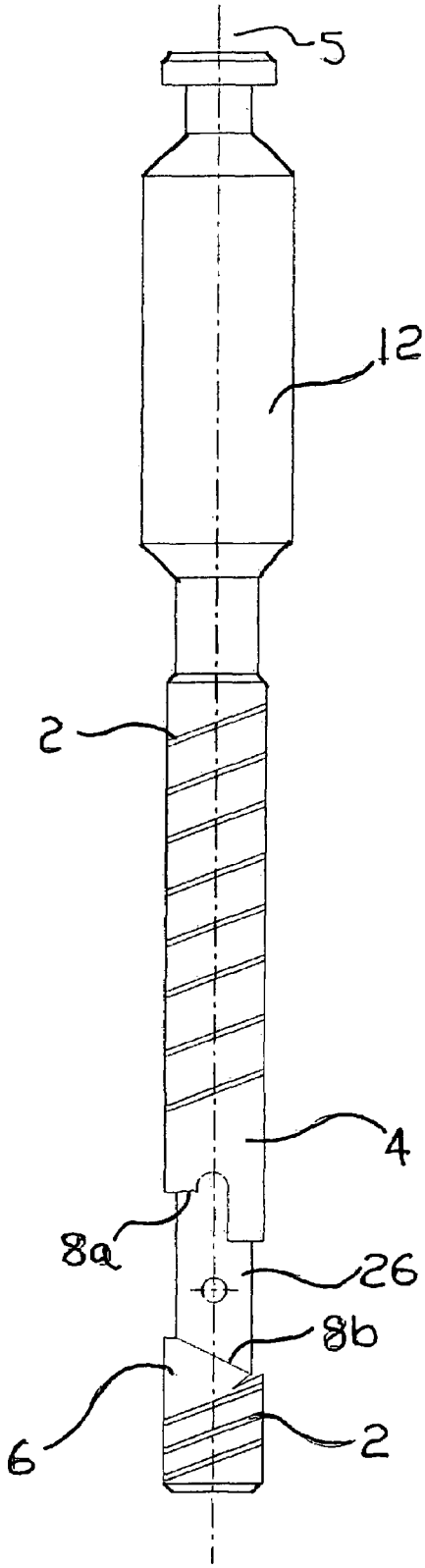
FIG. 2 depicts an embodiment of the fuel injection lubrication mechanism wherein the helical grooves are formed about both the first portion of the control surface plunger and the second portion of the control surface of the plunger adjacent to the control helix.

FIG. 2 depicts an embodiment of the fuel injection lubrication mechanism wherein the helical grooves 2 are formed about both the first portion 4 of the plunger control surface 4 adjacent to the first ridge 8*a* and the second portion 6 of the control surface adjacent to the second ridge 8*b*. The plunger 12 includes a first 8*a* and a second 8*b* opposed ridge formed within and encircling an axial portion of the plunger 12. The first ridge 8*a* is commonly known as the timing helix and the second ridge 8*b* is commonly known as the control helix. A recessed channel 26 encircling the axial portion of the plunger 12 is positioned between the ridges 8(*a-b*) for determining a quantity of fuel to be delivered. As shown in FIG. 2, adjacent to the first ridge 8*a* or timing helix 8*a* is a first control surface 4 of the plunger 12 having helical grooves 2 formed within the control surface. Also shown is an embodiment wherein helical grooves 2 are formed within the second control surface 6 adjacent to the second ridge 8(*b*) or control helix.

Figure 3:
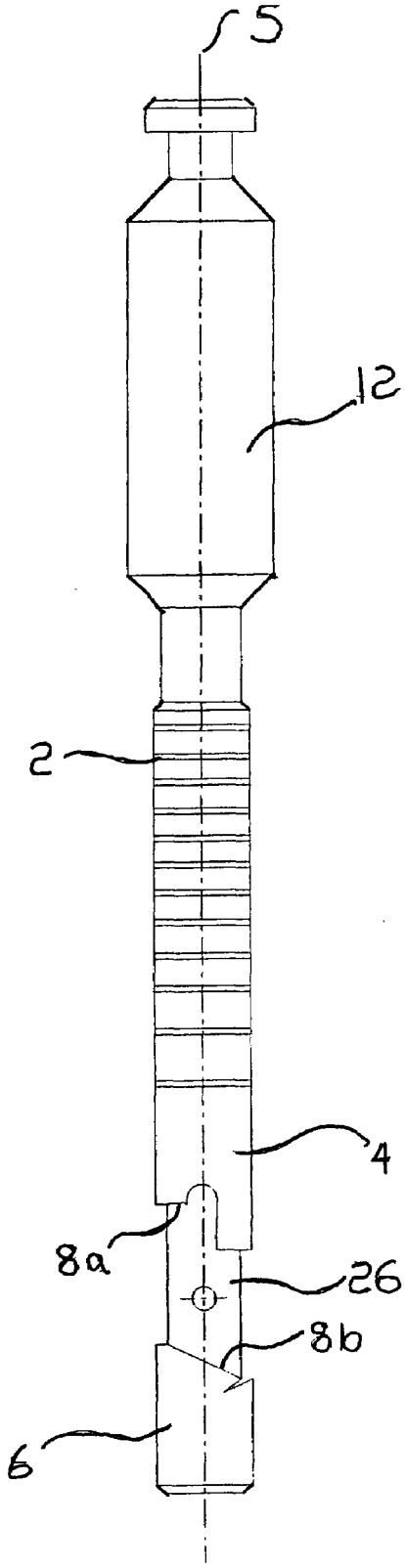
FIG. 3 illustrates the plunger having horizontal grooves about the axis of the plunger for storing or retaining fuel for lubricating the plunger and bushing.

FIG. 3 depicts horizontal grooves 2 formed within the body of the plunger in a similar manner as the helical grooves 2. The horizontal grooves may be formed within either the first control surface 4, the second control surface 6 or both surfaces. The horizontal grooves 10 may be continuous about the axis of the plunger 12 such that they are self contained about the axis.

Figure 4:
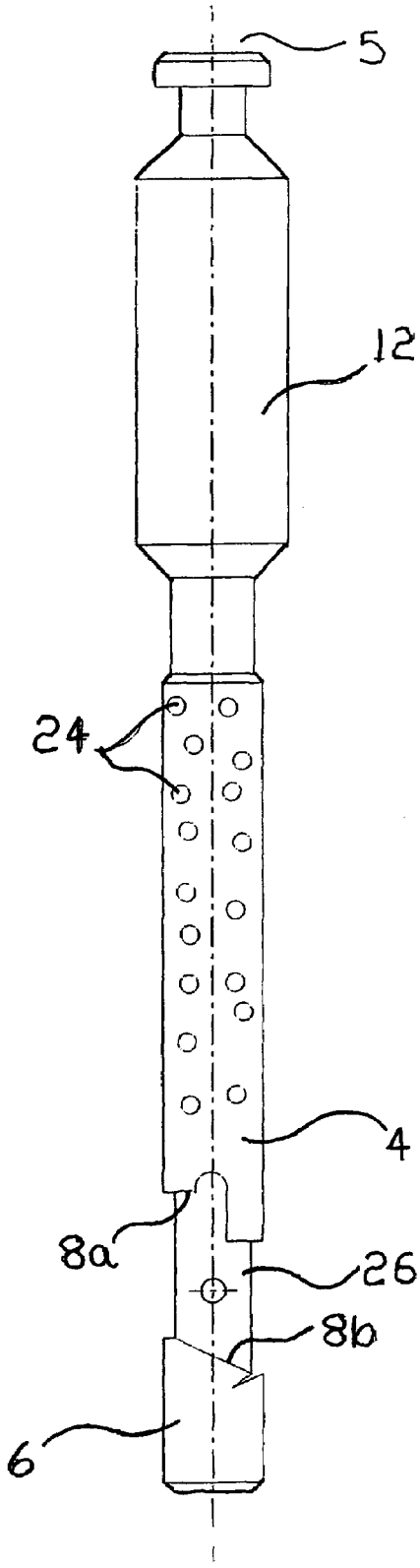
FIG. 4 depicts various fuel reservoirs about the axis of the plunger having a circular or concave shaped depression formed on the outer axial surface of the plunger for storing fuel for lubrication.

FIG. 4 depicts various fuel reservoirs 24 about the outer axial surface of the plunger 12 having a circular or concave shape for storing fuel for lubrication. The reservoirs 24 may be formed of varying depths and sizes relative to each other and/or varying depths and sizes relative to the plunger 12. The lubricating fuel reservoirs 24 may comprise up to about 10 percent of a total surface area of the outer circumference of the first control surface 4 and/or second control surface 6. In a further embodiment, the lubricating fuel reservoirs 24 may comprise between about one (1) percent up to about twenty (20) percent of a total surface area of the outer circumference of the first control surface 4 and/or second control surface 6. The lubricating fuel reservoirs 24 may be selected from the group having a configuration of a ringed groove, depression or a combination of both.

Figure 5:
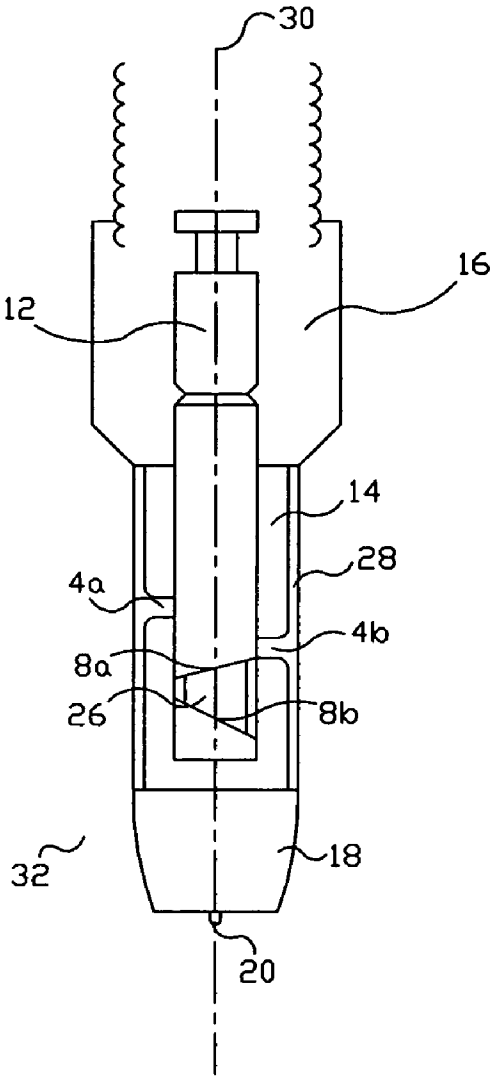
FIG. 5 is a partial cutaway view of a fuel injector having helical grooves.

FIG. 5 is a partial cutaway cross-sectional view of a fuel injector 32 according to an embodiment. The fuel injector 32 may be an injector for a fuel system of an engine, such as a diesel engine manufactured by GM EMD (General Motors Electro-Motive Division). EMD-type engines employ mechanical control of injection timing and may be implemented effectively in various settings. For example, locomotive (line-haul, switcher, passenger, or road), marine propulsion, offshore- and land-based oil well drilling rigs, stationary electric power generation, nuclear power generating plants, and pipeline and dredge pump applications. In one embodiment, injector 32 is implemented in an EMD 567, 645, or 710 series engine.

The fuel injector 32 includes a body 16, a plunger 12, a housing nut 28, a bushing 14, a nozzle tip 18, and spray holes 20. Other components of injector 32 are not shown in FIG. 5 and are known in the art. The fuel injector 32 is generally located and seated in a hole of a cylinder head of an engine fuel system or cylinder assembly system. Plunger 12 slidably fits within bushing 14. The bushing 14 includes an upper port 4*a* or fuel inlet port 4*a* and a lower port 4*b* or fuel return port 4*b*. The upper fuel inlet port 4*a* and lower fuel return port 4*b* are pathways for fuel. The amount of fuel injected into a cylinder depends on the extent to which the ports are closed during the downward plunger stroke.

The specific form of plunger 12, including diameter, roundness, and straightness thereof, may vary depending on the implementation. Diameters of plungers may vary depending on the amount of fuel that is needed for injection. For example, the plunger 12 may have a diameter of between about 8 and 22 mm. Materials for the plunger 12 may be chosen to prevent the plunger 12 from substantial wear, thus to prevent performance of the plunger 12 from being degraded. The plunger 12 may be formed of bearing quality or high alloy steel, such as a chromium/nickel alloy. By way of example, the steel may conform to the 51501 or 52100 specifications of the Society of Automotive Engineers (SAE).

As depicted in FIG. 5, the plunger 12 includes helical grooves formed within the first control surface of the plunger 12 which is adjacent to the first ridge 8*a* or timing helix 8*a*. The first ridge 8*a* and second ridge 8*b* determine the opening and closing of upper port 4*a* and lower port 4*b* of bushing 14 respectively. The opposed ridges 8(*a-b*) further define a shallow recessed fuel channel 26 encircling an axial portion of plunger 12. The first ridge 8*a* determines when injection starts, and the second ridge 8*b* determines when injection ends. Thus, in combination with the first ridge 8*a*, the second ridge 8*b* determines the volume of fuel that is injected.

The plunger 12 may be given a constant stroke reciprocating motion by an injector cam lobe directly acting through a rocker arm and injector follower (not shown). An adjusting screw (not shown) at the end of the rocker arm may be used to set the static timing of the injection period during the plunger stroke. The plunger 12 may be rotated via a rack and gear (not shown), as known in the art. Rotation of the plunger 12 regulates the time that the upper port 4*a* and the lower port 4*b* may open and close during the downward plunger stroke, thus determining the quantity of fuel injected into the combustion chamber. As plunger 12 is rotated from the idle throttle position to full throttle position, the pumping length of the stroke is increased, injection may be started earlier, and more fuel is injected.

Proper atomization of fuel is accomplished by the high pressure created during the downward stroke of plunger 12, which forces fuel past a needle valve (not shown), causing the needle valve to lift, thus forcing fuel out through spray holes 20 in nozzle spray tip 18 of injector 32.

FIG. 6 further illustrates an embodiment wherein the plunger 12 includes vertical grooves 2 parallel to the longitudinal axis 5 of the plunger 12 and circumscribed within the outer circumference of the plunger 12. The vertical grooves 2 may be spaced about the outer circumference of the plunger 12 in evenly spaced intervals or spaced in varying intervals depending upon the desired lubrication needs. The vertical groove 2 may be circumscribed to varying depths and may have varying lengths about the longitudinal axis 5 of the plunger 12. The vertical grooves 2 are self cleaning and retain or store fuel within the grooves 2 to provide lubrication for the fuel injector.

FIG. 7 depicts the plunger 12 having opposed helical grooves 2 circumscribed within and about the outer circumference of the plunger 12 wherein the opposed helical grooves 2 intersect at an angle to form a cross-hatching pattern about the outer circumference of the plunger 12. The cross-hatching of the outer circumference of the plunger 12 may be complete or partial and may be combined with the other various embodiments of the present invention as call the present embodiments disclosed herein. The angle of intersection may take any form but in an embodiment the grooves intersect at angle between 10 degrees and 45 degrees. The cross-hatched grooves 2 store fuel for lubricating the fuel injector. The area of the parallelogram formed by the intersection of the cross-hatched grooves 2 may have varying areas about the outer circumference of the plunger 12. Portions of the outer circumference of the plunger 12 where the areas of the formed parallelograms are smaller are typically designated as regions needing increased lubrication.

While Applicants have set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

The invention claimed is:

1. A fuel injection lubrication mechanism for lubricating a fuel injector comprising:

a plunger having helical grooves circumscribed within and about the outer circumference of the plunger and the grooves having a depth relative to the surface of the outer circumference of the plunger up to about 0.1 inches whereby retained fuel within the grooves provides lubrication for the fuel injector.

2. The fuel injection lubrication mechanism of claim 1, wherein the helical grooves are continuous whereby the grooves are self cleaning.

3. The fuel injection lubrication mechanism of claim 1, wherein the distance separating the helical grooves is varied whereby lubrication can be increased as the distance between the helical grooves decreases.

4. The fuel injection lubrication mechanism of claim 1, wherein the plunger includes;

a first and a second opposed ridge, a recessed channel positioned there between the opposed ridges, the recessed channel defined by the first and second opposed ridges and encircling an axial portion of the plunger, wherein the recessed channel separates a first and second control surface of the plunger, and wherein the helical grooves reside in the first portion of the control surface of the plunger.

5. The fuel lubrication mechanism of claim 4, wherein the helical grooves further reside in the second portion of the control surface of the plunger.

6. A plunger for a fuel injector comprising:

a first and a second opposed ridge formed within and encircling an axial portion of the plunger;

a recessed channel positioned between the first and second opposed ridges, wherein the recessed channel being defined by the first and second opposed ridges and encircling an axial portion of the plunger;

a first control surface adjacent to the first ridge and a second control surface adjacent to the second ridge;

a lubricating fuel reservoir formed within the first control surface comprising up to about 10 percent of a total surface area of the outer circumference of the first control surface.

7. The plunger of claim 6, wherein the lubricating fuel reservoir further resides in the second portion of the control surface of the plunger.

8. The plunger of claim 6, further including a plurality of discontinuous fuel reservoirs.

9. The plunger of claim 8, wherein the discontinuous fuel reservoirs are selected from the group having a configuration of ringed grooves, material voids, depressions and combinations thereof.

10. A fuel injection mechanism for regulating the volume of fuel injected comprising:

a body wherein the body housing a rotatable plunger slidably fitting within a bushing;

a first and a second port opening formed within the bushing; and wherein the plunger includes a first and a second opposed ridge and a recessed channel positioned there between, the recessed channel defined by the first and second opposed ridges and encircling an axial portion of the plunger, wherein the recessed channel separating the outer circumference of the plunger and defining a first and second control surface of the plunger, and helical grooves residing in a portion of the control surface of the plunger, and wherein the grooves have a depth relative to the surface of the outer circumference of the plunger of up to about 0.1 inches.

11. A fuel injection mechanism 10, wherein the distance separating the helical grooves is varied whereby lubrication can be increased as the distance between the helical grooves decreases.

12. A diesel engine, comprising:

a fuel system, the fuel system including, a plurality of cylinders;

a plurality of fuel injection mechanisms seated in respective cylinders, each injection mechanism including a body, a rotatable plunger slidably fitting within a bushing, and a nozzle spray tip;

helical grooves formed within the plunger for lubricating the plunger within the bushing and wherein the grooves have a depth relative to the surface of the outer circumference of the plunger of up to about 0.1 inches;

a rack and governor constructed and arranged to control rotation of the plunger;

a fuel supply line to supply fuel to the injection mechanisms; and a fuel return line to return fuel to a fuel supply tank cooperating with the engine.

13. The diesel engine of claim 12, wherein the plunger includes a first and a second opposed ridge and a recessed channel formed there between and defined by the first and second opposed ridges and encircling an axial portion of the plunger, wherein the recessed channel separating the outer circumference of the plunger and defining a first and second control surface of the plunger, and the helical grooves residing in a portion of at least one of the control surfaces of the plunger.

14. The diesel engine of claim 12, wherein the distance separating the helical grooves is varied whereby lubrication can be increased as the distance between the helical grooves decreases.

15. A method of lubricating a fuel injection mechanism for regulating the volume of fuel injected;

forming within an outer axial surface of a plunger fuel reservoirs, wherein the helical fuel reservoirs to a depth relative to the surface of the outer circumference of the plunger up to about 0.1 inches;

supplying to the fuel reservoirs a quantity of fuel; and lubricating walls of a bushing in cooperation with the plunger with the fuel supplied to the fuel reservoirs.

16. The method of claim 15, further including forming helical fuel reservoirs about the outer axial surface of the plunger.

17. The method of claim 15, wherein the distance separating the grooves is varied whereby lubrication can be increased as the distance between the grooves decreases.

18. A fuel injection lubrication mechanism for lubricating a fuel injector comprising:

a plunger having vertical grooves parallel to the longitudinal axis of the plunger and the grooves circumscribed within the outer circumference of the plunger, wherein the vertical grooves have a depth relative to the surface of the outer circumference of the plunger up to about 0.1 inches and whereby retained fuel within the grooves provides lubrication for the fuel injector.

19. The fuel injection lubrication mechanism of claim 18, wherein the vertical grooves are continuous whereby the grooves are self cleaning.

20. The fuel injection lubrication mechanism of claim 18, wherein the distance separating the vertical varies whereby areas of the outer circumference plunger can be designated for increased lubrication.

21. The fuel injection lubrication mechanism of claim 18, wherein the plunger includes;

a first and a second opposed ridge, a recessed channel positioned there between the opposed ridges, the recessed channel defined by the first and second opposed ridges and encircling an axial portion of the plunger, wherein the recessed channel separates a first and second control surface of the plunger, and wherein the vertical grooves reside in the first portion of the control surface of the plunger.

22. The fuel lubrication mechanism of claim 21, wherein the vertical grooves further reside in the second portion of the control surface of the plunger.

23. A fuel injection lubrication mechanism for lubricating a fuel injector comprising:

a plunger having opposed helical grooves circumscribed within and about the outer circumference of the plunger to a depth relative to the surface of the outer circumference of the plunger up to about 0.1 inches wherein the opposed helical grooves intersecting at an angle to form a cross-hatching pattern about the outer circumference of the plunger and whereby retained fuel within the grooves provides lubrication for the fuel injector.

24. The fuel injection lubrication mechanism of claim 23, wherein the opposed helical grooves are continuous whereby the grooves are self cleaning.

25. The fuel injection lubrication mechanism of claim 23, wherein the plunger includes;

a first and a second opposed ridge, a recessed channel positioned there between the opposed ridges, the recessed channel defined by the first and second opposed ridges and encircling an axial portion of the plunger, wherein the recessed channel separates a first and second control surface of the plunger, and wherein the opposed helical grooves reside in the first portion of the control surface of the plunger.

26. The fuel lubrication mechanism of claim 25, wherein the opposed helical grooves further reside in the second portion of the control surface of the plunger.

* * * * *